US009163638B2

(12) United States Patent
Chen

(10) Patent No.: US 9,163,638 B2
(45) Date of Patent: Oct. 20, 2015

(54) ELECTRONIC DEVICE WITH FAN

(75) Inventor: Chin-Hsien Chen, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 772 days.

(21) Appl. No.: 13/445,933

(22) Filed: Apr. 13, 2012

(65) Prior Publication Data

US 2013/0156568 A1 Jun. 20, 2013

(30) Foreign Application Priority Data

Dec. 20, 2011 (TW) ..... 100147260 A

(51) Int. Cl.
*F04D 29/42* (2006.01)
*F04D 25/06* (2006.01)
*F04D 29/52* (2006.01)

(52) U.S. Cl.
CPC ..... *F04D 25/0613* (2013.01); *F04D 29/522* (2013.01)

(58) Field of Classification Search
CPC ..... F04D 1/006; F04D 1/04; F04D 17/06; F04D 17/08; F04D 17/16; F04D 17/162; F04D 25/08; F04D 29/4206; F04D 29/422; F04D 29/4226
See application file for complete search history.

(56) References Cited

U.S. PATENT DOCUMENTS 6,238,181 B1 * 5/2001 Chen ..... 415/175
2006/0292020 A1 * 12/2006 Hwang et al. ..... 417/423.13

* cited by examiner

*Primary Examiner* — Nathaniel Wiehe
*Assistant Examiner* — Brian O Peters
(74) *Attorney, Agent, or Firm* — Novak Druce Connolly Bove + Quigg LLP

(57) ABSTRACT

An electronic device includes a casing and a fan received in the casing. The fan includes a cover plate, a bottom plate and a side wall. An air outlet is defined in the side wall. The bottom plate defines an air inlet. The casing includes a bottom cover and a top cover. The bottom cover includes a base plate, and a side plate extending upwardly from a periphery of the base plate. The bottom plate includes a horizontal first area and a second area inclining relative to the first area. A height of the base plate relative to a horizontal plane gradually increases from one side of the casing to another side of the casing. A height of the second area relative to the horizontal plane also gradually increases from the one side of the casing to another side of the casing.

20 Claims, 2 Drawing Sheets

ELECTRONIC DEVICE WITH FAN

BACKGROUND

1. Technical Field

The disclosure relates to electronic devices, and particularly to an electronic device with a fan mounted therein having an excellent heat dissipation capability.

2. Description of Related Art

Nowadays, with the development of electronic technology, an electronic device such as a computer or a server is devised to be much thinner and smaller than before, yet hold many more electronic modules. However, the electronic modules generate a large amount of heat during operation. The interior space of the electronic device is very limited, and the electronic modules occupy much of that space. Therefore, the space saved for a fan for dissipating heat generated from the electronic modules is becoming smaller and smaller, and a gap between the fan and a casing of the electronic device is becoming narrower and narrower. During operation, only a little of ambient air is drawn along the gap by the fan, and heat dissipation capability of the fan is very limited. As a result, heat generated by the electronic modules cannot be efficiently taken away.

What is needed, therefore, is an electronic device with a fan mounted therein which can overcome the limitations described.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

Figure 1:
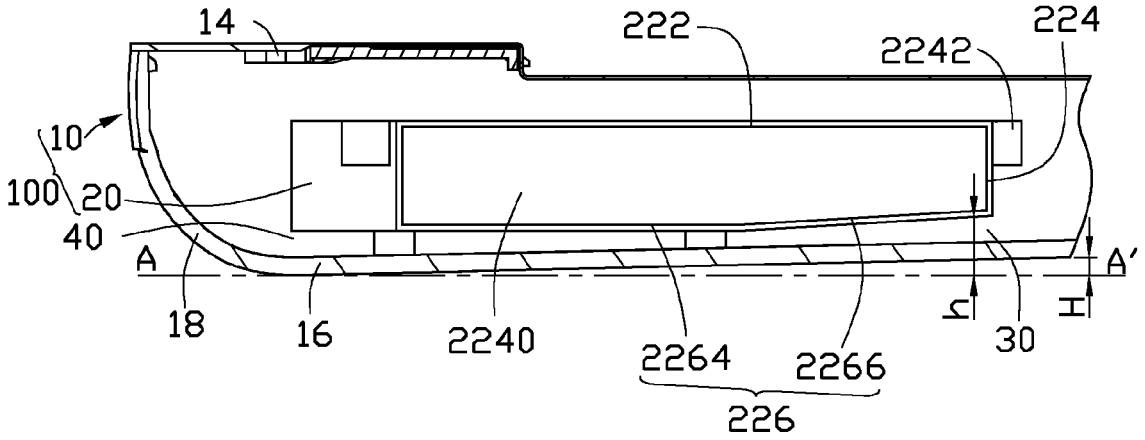
FIG. 1 is a cross sectional view of an electronic device in accordance with an embodiment of the disclosure.

Referring to FIG. 1, an electronic device 100 in accordance with an embodiment of the disclosure includes a casing 10 and a fan 20 received in the casing 10. In this embodiment, the electronic device 100 is a notebook computer, and the fan 20 is a centrifugal fan.

Figure 2:
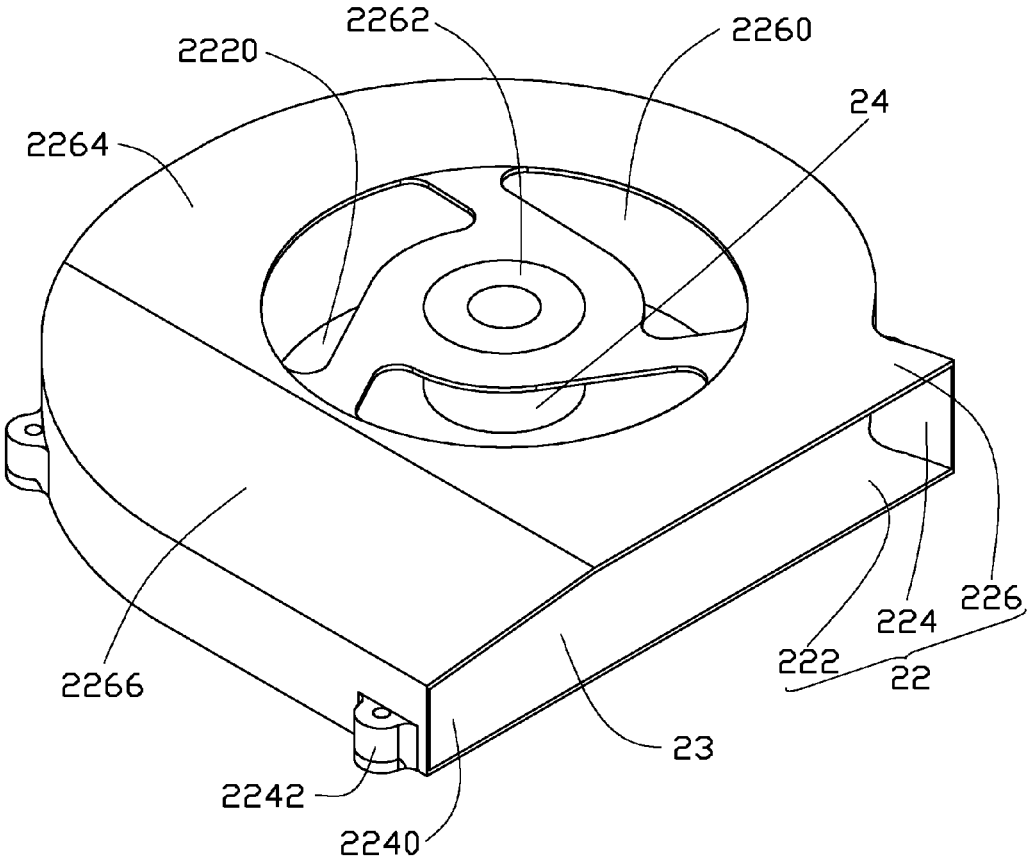
FIG. 2 is an isometric view of an inverted fan of the electronic device of FIG. 1.

Also referring to FIG. 2, the fan 20 includes a fan frame 22 and an impeller 24 mounted in the fan frame 22. The fan frame 22 includes a first plate, a second plate, and a sidewall 224 interconnecting the first plate and the second plate. In this embodiment, the first plate is a bottom plate 226, and the second plate is a cover plate 222. The cover plate 222, the bottom plate 226 and the sidewall 224 cooperatively form a chamber 23 receiving the impeller 24 therein. The fan 20 defines an air outlet 2240 in the sidewall 224, three first air inlets 2260 in the bottom plate 226, and a second air inlet 2220 in the cover plate 222. The air outlet 2240 is perpendicular to the first air inlets 2260 and the second air inlet 2220, and the first air inlets 2260 align with the second air inlet 2220. Ambient airflow flows into the fan 20 through the first air inlets 2260 and the second air inlet 2220, and flows out of the fan 20 via the air outlet 2240.

The bottom plate 226 includes a fixing seat 2262 at a center thereof. The impeller 24 is fixed on the fixing seat 2262. The three first air inlets 2260 are around the fixing seat 2262. The bottom plate 226 includes a horizontal first area 2264 and an inclined second area 2266 slantwise from the first area 2264 towards the cover plate 222 of the fan frame 22. The first air inlets 2260 are defined in the first area 2264. The second area 2266 extends from the air inlets 2260 along a direction away from the air inlets 2260. The second area 2266 has a lateral side in connection with the sidewall 224, and an opposite lateral side near the first air inlets 2260. The sidewall 224 has a height near the first area 2264 larger than that near the second area 2266. Therefore, a portion of the air outlet 2240 between the first area 2264 and the cover plate 2240 has a height larger than that of another portion of the air outlet 2240 between the second area 2266 and the cover plate 2240.

The second air inlet 2220 is defined in a center of the cover plate 222, opposite to the first air inlets 2260 in the bottom plate 226. A plurality of protrusions 2242 protrude outward from a periphery of the sidewall 224 for mounting the fan 20 on the casing 10 of the electronic device 100.

The casing 10 includes a first cover, a second cover and a side plate 18 between the first and second covers. In this embodiment, the first cover is a bottom cover 16, and the second cover is a top cover 14. A side plate 18 extends upwardly from an outer periphery of the bottom cover 16 as a single piece. The first air inlets 2260 of the fan 20 are located near the bottom cover 16 of the casing 10. The second air inlet 2220 of the fan 20 is located near the top cover 14 of the casing 10. Namely, the bottom cover 16 faces the bottom plate 226 of the fan 20, and the top cover 14 faces the top plate 222 of the fan 20. The air outlet 2240 of the fan 20 is oriented to the side plate 18 of the casing 10. The bottom cover 16 extends upwardly and slantwise relative to a horizontal plane AA' which is parallel to the top cover 14 as actual required. Such an arrangement, a first side, i.e. left side, of the casing 10 has a thickness larger than that of a second side, i.e. right side, of the casing 10. A height H of the bottom cover 16 relative to the horizontal plane AA' gradually increases from the left side of the casing 10 to the right side of the casing 10. The bottom plate 226 of the fan 20 is located near but spaced from the bottom cover 16 of the casing 10. The first area 2264 of the bottom plate 226 is located near the left side of the casing 10. The second area 2266 of the bottom plate 226 is located near the right side of the casing 10. A height h of the second area 2266 relative to the horizontal plane AA' also gradually increases from the left side of the casing 10 to the right side of the casing 10. A larger gap 30 between the second area 2266 of the fan 20 and the bottom cover 16 of the casing 10 is achieved, and substantially equal to a gap 40 between the first area 2264 of the fan 20 and the bottom cover 16 of the casing 10 in size.

According to the disclosure, since the height h of the second area 2266 of the fan 20 relative to the horizontal plane AA' increases from the left side to the right side of the casing 10, the gap 30 between the second area 2266 of the fan 20 and the bottom cover 16 of the casing 10 is not reduced even though the height H of the bottom cover 16 of the casing 10 relative to the horizontal plane AA' increases from the left side to the right side of the casing 10. This facilitates more airflow flowing into the first air inlets 2260 along the gap 30. Thus, a heat dissipation efficiency of the electronic device 100 is improved.

It is believed that the embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An electronic device comprising:

a casing comprising a first cover with a height relative to a horizontal plane increasing from a first side of the casing to a second side of the casing; and a fan received in the casing, the fan comprising a fan frame and an impeller mounted in the fan frame, the fan frame comprising a first area corresponding to the first side of the casing, and a second area corresponding to the second side of the casing and slantwise from the first area, a height of the second area relative to a horizontal plane also increasing from the first side to the second side of the casing.

2. The electronic device of claim 1, wherein an air inlet is defined in the first area.

3. The electronic device of claim 2, wherein the second area is located adjacent to the air inlet in the first area.

4. The electronic device of claim 1, wherein the fan frame comprises a first plate, a second plate, and a sidewall interconnecting the first plate and the second plate, the first plate comprising the first area and the second area.

5. The electronic device of claim 4, wherein the sidewall has a height adjacent to the first area larger than the height of the sidewall at or adjacent to the second area.

6. The electronic device of claim 4, wherein the casing further comprises a second cover and a side plate between the first and second covers, the first cover facing the first plate of the fan, the second cover facing the second plate of the fan.

7. The electronic device of claim 6, wherein the first plate of the fan is located adjacent to but spaced from the first cover of the casing.

8. The electronic device of claim 6, wherein the first plate is a bottom plate, the second plate being a cover plate, the first cover being a bottom cover, the second cover being a top cover.

9. The electronic device of claim 4, wherein the first plate, the second plate and the sidewall of the fan cooperatively form a chamber for receiving the impeller therein, the second area extending slantwise from the first area towards the chamber.

10. The electronic device of claim 4, wherein an air outlet being defined in the sidewall, the second area extending from the air outlet along a direction away from the air outlet.

11. The electronic device of claim 10, wherein another air inlet is defined in the second plate of the fan, and opposite to the air inlet in the first plate, the air outlet being perpendicular to the air inlets in the first and second plates.

12. The electronic device of claim 10, wherein the air outlet of the fan is oriented to the side plate of the casing.

13. An electronic device comprising:

a casing comprising a first cover, one portion of the first cover having an increased height relative to a horizontal plane; and a fan received in the casing, the fan comprising a first plate facing the first cover of the casing, the first plate comprising a first area, and a second area slantwise from the first area and corresponding to the portion of the first cover with increased height, a height of the second area relative to the horizontal plane also increasing consistent with the portion of the first cover.

14. The electronic device of claim 13, wherein an air inlet is defined in the first area of the first plate.

15. The electronic device of claim 14, wherein the second area is located adjacent to the air inlet in the first area.

16. The electronic device of claim 13, wherein the fan further comprises a second plate, and a sidewall interconnecting the first and second plates, the sidewall having a height adjacent to the first area larger than that adjacent to the second area.

17. The electronic device of claim 16, wherein the casing further comprises a second cover and a side plate between the first and second covers, the second cover facing the second plate of the fan.

18. The electronic device of claim 17, wherein the first plate is a bottom plate, the second plate being a cover plate, the first cover being a bottom cover, the second cover being a top cover.

19. The electronic device of claim 16, wherein the first plate, the second plate and the sidewall of the fan cooperatively form a chamber for receiving the impeller therein, the second area extending slantwise from the first area towards the chamber.

20. The electronic device of claim 16, wherein an air outlet being defined in the sidewall, the second area extending from the air outlet along a direction away from the air outlet.

* * * * *